US010210979B2

(12) United States Patent
Olausson et al.

(10) Patent No.: US 10,210,979 B2
(45) Date of Patent: Feb. 19, 2019

(54) DRIVER CIRCUIT FOR ELECTROMAGNETIC DISPENSER

(71) Applicant: Electrolux Appliances Aktiebolag, Stockholm (SE)

(72) Inventors: Mats Olausson, Stockholm (SE); Johan Waldebäck, Stockholm (SE)

(73) Assignee: Electrolux Appliances Aktiebolag, Stockholm (SE)

( * ) Notice: Subject to any disclaimer, the term of this patent is extended or adjusted under 35 U.S.C. 154(b) by 619 days.

(21) Appl. No.: 14/784,701

(22) PCT Filed: May 27, 2013

(86) PCT No.: PCT/EP2013/060877
§ 371 (c)(1),
(2) Date: Oct. 15, 2015

(87) PCT Pub. No.: WO2014/191017
PCT Pub. Date: Dec. 4, 2014

(65) Prior Publication Data
US 2016/0071641 A1 Mar. 10, 2016

(51) Int. Cl.
*H01F 7/18* (2006.01)
*A47L 15/44* (2006.01)

(52) U.S. Cl.
CPC ..... *H01F 7/1816* (2013.01); *A47L 15/449* (2013.01); *H01F 2007/1822* (2013.01)

(58) Field of Classification Search
CPC ..... H01F 38/14; H01F 7/1877
See application file for complete search history.

(56) References Cited

U.S. PATENT DOCUMENTS 4,220,872 A 9/1980 Fahey
5,729,422 A 3/1998 Henke
(Continued)

FOREIGN PATENT DOCUMENTS

DE 197 06 247 A1 8/1998
FR 2 779 287 A1 12/1999
(Continued)

OTHER PUBLICATIONS

FR-2779287-A1 English Translation, accessed on Apr. 2018. (Year: 1999).*
Office Action for Australian Patent Application No. 2013391065 dated Mar. 21, 2017, 3 pages.
(Continued)

*Primary Examiner* — Hai L Nguyen
(74) *Attorney, Agent, or Firm* — Alston & Bird LLP

(57) ABSTRACT

A circuit for driving an inductive load may include an input, an output, a first switch, and at least one capacitor. The first switch may cause the capacitor to be charged by the supply voltage via the inductive load. A device may discontinue the charging of the capacitor when the voltage has reached a predetermined level greater than that of the supply voltage. A first and a second diode may prevent the capacitor from discharging via the first switch and blocking inductive load current from entering the power supply, respectively. A second switch and the capacitor may be connected to the third switch to cause discharging of the capacitor via the third switch into the inductive load. Closing of the first switch may cause a current sufficient for actuating a mechanical valve to be induced in the inductive load.

11 Claims, 3 Drawing Sheets

(56) References Cited

U.S. PATENT DOCUMENTS

| | | | | |
|---|---|---|---|---|
| 5,844,786 | A | 12/1998 | Yoshida et al. | |
| 5,930,104 | A | 7/1999 | Kadah et al. | |
| 6,784,721 | B2 * | 8/2004 | Torrisi | H03K 17/168 323/271 |
| 7,057,870 | B2 | 6/2006 | Meyer et al. | |
| 7,911,758 | B2 | 3/2011 | Haller | |
| 8,981,820 | B2 * | 3/2015 | Bodano | H03K 17/165 327/109 |
| 2004/0231667 | A1 | 11/2004 | Horton et al. | |
| 2005/0022806 | A1 | 2/2005 | Beaumont et al. | |
| 2005/0047053 | A1 | 3/2005 | Meyer et al. | |
| 2009/0284891 | A1 | 11/2009 | Haller | |
| 2011/0242868 | A1 | 10/2011 | Gray et al. | |
| 2012/0180762 | A1 | 7/2012 | Casasso | |

FOREIGN PATENT DOCUMENTS

| | | | | |
|---|---|---|---|---|
| FR | 2779287 | A1 * | 12/1999 | H01H 47/325 |
| GB | 2 383 698 | A | 7/2003 | |

OTHER PUBLICATIONS

International Search Report for corresponding International Application No. PCT/EP2013/060877, dated Nov. 18, 2013.

*Solenoid—Wikipedia, the free encyclopedia* [online] [Retrieved Oct. 13, 2015]. Retrieved from the Internet: <URL: https://web.archive.org/web/20130723003313/https://en.wikipedia.org/wiki/Solenoid>. (Jun. 24, 2013) 6 pages.

Office Action for Canadian Application No. 2,908,629 dated Oct. 18, 2018, 3 pages.

* cited by examiner

DRIVER CIRCUIT FOR ELECTROMAGNETIC DISPENSER

CROSS-REFERENCE TO RELATED APPLICATIONS

This application is a national stage application filed under 35 U.S.C. § 371 of International Application No. PCT/EP2013/060877 filed May 27, 2013, which application is hereby incorporated by reference in its entirety.

TECHNICAL FIELD

The invention relates to a method and a circuit for driving an inductive load.

BACKGROUND

In the art, a problem arises when an electric system comprises one or more components which require a higher supply voltage to operate adequately than a power supply of the electric system is capable of delivering.

U.S. Pat. No. 7,911,758 discloses a solenoid control circuit including a power source in series with a sensing element, an inductor to actuate a valve, an energy storage device to store and discharge energy into the inductor, diodes to control current flow, and switches and a controller to control the circuit. The circuit may be operated by closing a first switch, thereby allowing a source current to flow through an inductor; opening the first switch, thereby forcing a charge current to flow through an energy storage device utilizing the inductance of the inductor; repeating these steps until the energy storage device is sufficiently charged; and upon command, closing a second switch, thereby forcing a discharge current to flow from the energy storage device to the inductor causing the inductor to produce an actuating magnetic field thereby actuating a mechanical valve.

However, in order to determine whether the energy storage device has been sufficiently charged, either the charging cycles are repeated a predetermined number of times as determined during manufacturing, or a microcontroller monitors the above mentioned sensing element. Repeating the charging cycles a predetermined number of times has the disadvantage on the one hand that there is a risk that the energy storage device is charged more than necessary, which is undesirable from a power consumption perspective, or on the other that the energy storage device is not sufficiently charged, which will prevent the solenoid from operating correctly. A disadvantage with the approach of having a microcontroller measuring the sensing device to determine whether the energy storage device is sufficiently charged is that a separate sensing device in the form of e.g. a precision shunt resistor is used to measure current passing through the sensing device.

SUMMARY

An object of the present invention is to solve, or at least mitigate, these problems in the art and to provide an improved circuit for driving an inductive load.

This object is achieved in a first aspect of the present invention by a method of driving an inductive load. The method comprises the steps of applying a supply voltage to the inductive load and closing and opening a first switch connected to a capacitor and the inductive load, wherein the capacitor is charged by the supply voltage via the inductive load. The method further comprises the steps of measuring a voltage over the charged capacitor, wherein the charging of the capacitor is discontinued when the voltage over the charged capacitor has reached a predetermined level greater than that of the supply voltage, and closing a second switch connected to a control terminal of a third switch, the capacitor further being connected to the control terminal and a source terminal of the third switch, wherein the third switch closes and causes the capacitor to discharge via the third switch into the inductive load. Finally, closing of the first switch causes a current sufficient for actuating a mechanical valve associated with the inductive load to be induced in the inductive load.

This object is achieved in a second aspect of the present invention by a circuit driving an inductive load comprising an input arranged to be connected to a supply voltage and an output arranged to apply the supply voltage to the inductive load, a first switch, and at least one capacitor. The first switch is connected to the capacitor and the inductive load, and closing and opening of the first switch causes the capacitor to be charged by the supply voltage via the inductive load. The circuit further comprises a device for measuring a voltage over the charged capacitor, which further is arranged to control the first switch to discontinue the charging of the capacitor when the voltage over the charged capacitor has reached a predetermined level greater than that of the supply voltage, a second switch, and a third switch being connected to the inductive load and the capacitor. The circuit further comprises a first diode, an anode terminal of which is connected to an input terminal of the first transistor and the inductive load and a cathode terminal of which is connected to the at least one capacitor and an input terminal of the third transistor. Moreover, the circuit comprises a second diode, an anode terminal of which is connected to the input for receiving the supply voltage and a cathode terminal of which is connected to an output terminal of the third transistor and the inductive load. The second switch is connected to a control terminal of the third switch, and the capacitor is further connected to the control terminal and an input terminal of the third switch, wherein closing of the second switch causes closing of the third switch and discharging of the capacitor via the third switch into the inductive load, Finally, closing of the first switch causes a current sufficient for actuating a mechanical valve associated with the inductive load to be induced in the inductive load.

In an embodiment, the circuit for and the method of driving an inductive load according to the present invention is typically used in a dish washer where the inductive load is embodied in the form of a solenoid valve used for opening a detergent dispenser in the dish washer in order to dispense detergent and/or rinse aid. The inductor of the solenoid valve is controllable to actuate a mechanical valve for opening the dispenser in that the current flowing through the inductor will create a magnetic field proportional to the current. If the current passing through the inductor is sufficiently large, the associated mechanical valve is actuated by the magnetic field produced.

The solenoid valve requires a greater voltage for actuation than the available supply voltage of a printed circuit board housing the circuit used for controlling the solenoid valve. Typically, a supply voltage of +5 V is available, while the solenoid valve requires at least +7 V for being actuated. Thus, in order to actuate the solenoid valve, it must be supplied with a minimum of +7 V over a longer time period, or temporarily be supplied with a voltage many times greater, say +30 V. Since it is not possible to supply the solenoid valve with +7 V during a longer period due to limitations in the supply voltage, the present invention facilitates provision of a voltage many times greater than the supply voltage for a relatively short time period thereby enabling actuation of the solenoid valve such that detergent and rinse aid can be dispensed into the compartment of the dish washer.

To this end, the circuit for driving the inductive load in the form of a solenoid valve comprises a first switch which is controlled to charge a capacitor from the +5 V voltage supply applied to the solenoid valve. This supply voltage is further used to feed most of the other components of the circuit. By closing the first switch, a current is induced in the solenoid from the supply voltage. Thereafter, when the first switch is opened, the current induced in the solenoid will charge the capacitor. This process of opening and closing the first switch is repeated until the capacitor is fully charged as measured by a device such as a microprocessor, an application specific circuit (ASIC), etc., measuring the voltage level over the capacitor. By repeating the charging cycle, the energy in the capacitor is steadily increased. A first diode may be employed for preventing the capacitor from discharging via the first switch, and a second diode may be used for protecting the power supply from current induced in the inductive load. When the capacitor is considered to be sufficiently charged, as determined by the microprocessor measuring the voltage over the capacitor and comparing the measured voltage to a predetermined level, which level in practice is approximately 30-32 V, the first switch is opened. Subsequently, a second switch is closed, the closing of which in its turn closes a third switch. The third switch must be able to handle a much greater voltage level than the rest of the components, i.e. a level of approximately 30-32 V. The second switch thus acts as a level shifter from 5 V to 32 V. Two resistors constitute a voltage divider at the control input of the third switch. By closing the second switch, the capacitor is discharged, and its stored voltage is transferred to the solenoid via the third switch. At this stage, when the first switch is closed, the voltage charged in the capacitor is transferred to the solenoid valve, which causes a correspondingly high current to flow through the inductor of the solenoid valve and via the first switch to ground. Thus, by charging the capacitor to a sufficient voltage level, a current pulse flowing through the solenoid is produced, which is great enough to actuate the valve associated with the inductor. The actuation of the valve will open the dispenser and dispense detergent into the compartment of the dish washer. Further advantageous is that the voltage over the charged capacitor is measured to determine whether a sufficiently high current pulse can be create in the solenoid, which requires no further sensing element(s).

Embodiments of the present invention are defined by the dependent claims.

It is noted that the invention relates to all possible combinations of features recited in the claims. Further features of, and advantages with, the present invention will become apparent when studying the appended claims and the following description. Those skilled in the art realize that different features of the present invention can be combined to create embodiments other than those described in the following.

BRIEF DESCRIPTION OF THE DRAWINGS

The invention is now described, by way of example, with reference to the accompanying drawings, in which.

DETAILED DESCRIPTION

The invention will now be described more fully hereinafter with reference to the accompanying drawings, in which certain embodiments of the invention are shown. This invention may, however, be embodied in many different forms and should not be construed as limited to the embodiments set forth herein; rather, these embodiments are provided by way of example so that this disclosure will be thorough and complete, and will fully convey the scope of the invention to those skilled in the art.

Figure 1A:
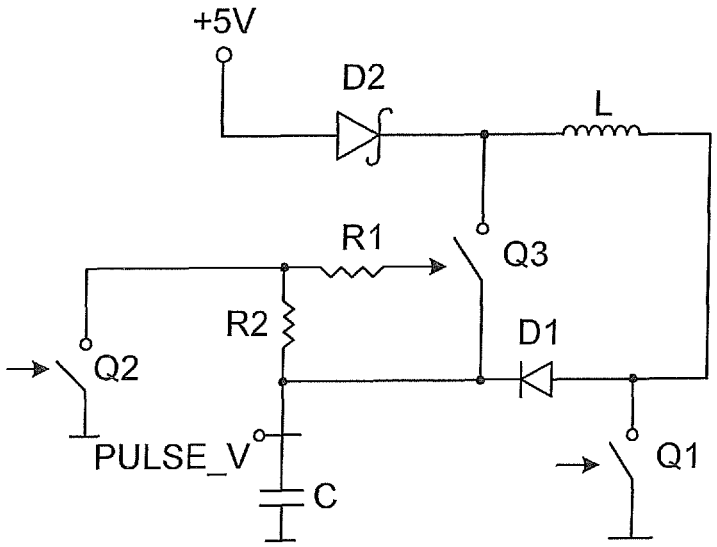
FIG. 1*a* shows a circuit diagram of a circuit for driving an inductive load in the form of a solenoid valve according to a first aspect of the present invention.

FIG. 1*a* shows a circuit diagram of a circuit for driving an inductive load in the form of a solenoid valve according to a first aspect of the present invention.

As previously has been mentioned, the solenoid valve used for opening the detergent dispenser in a dish washer in order to dispense detergent and/or rinse aid requires a greater voltage for actuation than the available supply voltage of the printed circuit board housing the electronic components used for controlling the solenoid valve. The inductor of the solenoid valve is controllable to actuate a mechanical valve for opening the dispenser in that the current flowing through the inductor will create a magnetic field proportional to the current. If the current passing through the inductor is sufficiently large, the associated mechanical valve is actuated by the magnetic field produced. Typically, a supply voltage of +5 V is available, while the solenoid valve requires at least +7 V for being actuated. Thus, in order to actuate the solenoid valve, it must be supplied with a minimum of +7 V over a longer time period, or temporarily be supplied with a voltage many times greater, say around +30 V (depending on the type of solenoid valve used). Since it is not possible to supply the solenoid valve with +7 V during a longer period due to limitations in the supply voltage, the present invention facilitates provision of a voltage many times greater than the supply voltage for a relatively short time period thereby enabling actuation of the solenoid valve such that detergent and rinse aid can be dispensed into the compartment of the dish washer.

To this end, the circuit for driving the inductive load in the form of a solenoid valve denoted L comprises a first switch Q1 which is controlled to charge a capacitor C from the +5 V voltage supply applied to the solenoid valve L. This supply voltage is further used to feed most of the other components of the circuit. By closing the first switch Q1, a current is induced in the solenoid L from the supply voltage. Thereafter, when the first switch is opened, the current induced in the solenoid L will charge the capacitor C. This process of opening and closing the first switch Q1 is repeated until the capacitor is fully charged as measured by a device such as a microprocessor (not shown) measuring the voltage level over the capacitor C, i.e. by measuring the signal denoted PULSE_V. By repeating the process of having the current induced in the solenoid L charge the capacitor C, the energy in the capacitor is steadily increased. A first diode D1 is employed in order to prevent the capacitor C from discharging via the first switch Q1. When the capacitor is considered to be sufficiently charged, as determined by the microprocessor measuring the voltage over the capacitor C and comparing the measured voltage to a predetermined level, which level in practice is approximately 30-32 V, the first switch Q1 is opened.

Thereafter, a second switch Q2 is closed, the closing of which in its turn closes a third switch Q3. The third switch Q3 must, as can be deducted from FIG. 1*a*, be able to handle a much greater voltage level than the rest of the components, i.e. a level of approximately 30-32 V. The second switch Q2 thus acts as a level shifter from 5 V to 32 V. Two resistors R1 and R2 constitute a voltage divider at the control input of the third switch Q3. In this context, it should be noted that the control current for closing and opening the third switch Q3 will amount to approximately 30 mA and the voltage across the voltage divider formed by R1 and R2 to approximately 32 V. The previously mentioned microprocessor will not be able to deliver a current of such a magnitude, in case the microprocessor would be coupled directly to the control input of the third switch Q3. Further, a microprocessor will not be able to handle a voltage at its output which is higher than about 0.5 V above the supply voltage (in this case +5 V). A voltage of this magnitude would damage the microprocessor. Hence, the second switch Q2 is required due to the limited voltage/current capacity of a microprocessor.

As can be seen in FIG. 1*a*, the circuit further comprises a second diode D2, advantageously a Schottky diode. An anode terminal of the Schottky diode D2 is connected to the +5 V power supply while a cathode terminal is connected to the inductive load L for protecting the power supply. The voltage drop of a Schottky diode is very low when the diode is forward-biased, while the diode blocks any possible discharge current from the solenoid when reverse-biased.

By closing the second switch Q2, the capacitor C is discharged, and its stored voltage is transferred to the solenoid L via the third switch Q3. At this stage, when the first switch Q1 is closed, the relatively high voltage (30-32 V) transferred to the solenoid valve L causes a correspondingly high current to flow through inductor of the solenoid valve L and via the first switch Q1 to ground. Thus, by charging the capacitor C to a sufficient voltage level, a current pulse flowing through the solenoid is produced, which is great enough to actuate the valve associated with the inductor L. The actuation of the valve will open the dispenser and dispense detergent into the compartment of the dish washer.

The first switch Q1 will be controlled to be open for as long as the valve of the solenoid valve is desired to be open. It should be noted that if the voltage transferred from the capacitor C via the third switch Q3 falls down to +5 V, being the lowest voltage supplied to the solenoid from the supply voltage, the valve associated with the solenoid will still be capable of being open for another 2 seconds before closing, in which case the capacitor C again must be charged in order to induce sufficient current in the solenoid for actuating the valve.

Figure 1B:
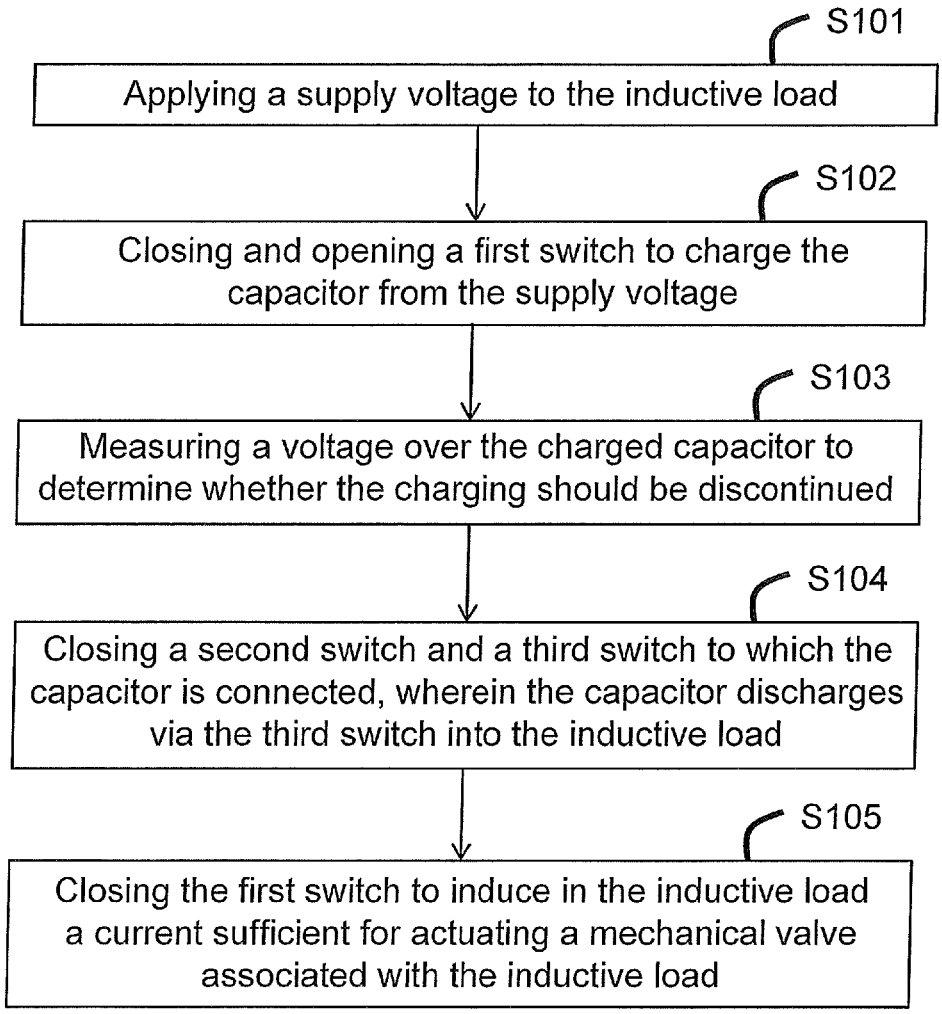
FIG. 1*b* illustrates a flowchart of a method of driving an inductive load according to a second aspect of the present invention.

FIG. 1*b* illustrates a flowchart of a method of driving an inductive load according to a second aspect of the present invention. In a first step S101, a supply voltage is applied to the inductive load. Thereafter, in step 102, a first switch connected to a capacitor and the inductive load is alternately closed and opened, wherein the capacitor is charged by the supply voltage via the inductive load. In a third step S103, a voltage is measured over the charged capacitor, wherein the charging of the capacitor is discontinued when the voltage over the charged capacitor has reached a predetermined level greater than that of the supply voltage. When the capacitor has been charged to a sufficient degree, a second switch connected to a control terminal of a third switch is closed in step S104, the capacitor further being connected to the control terminal and a source terminal of the third switch, wherein the third switch closes and causes the capacitor to discharge via the third switch into the inductive load. Finally, in step S105, the first switch is closed which causes a current sufficient for actuating a mechanical valve associated with the inductive load to be induced in the inductive load.

Figure 2:
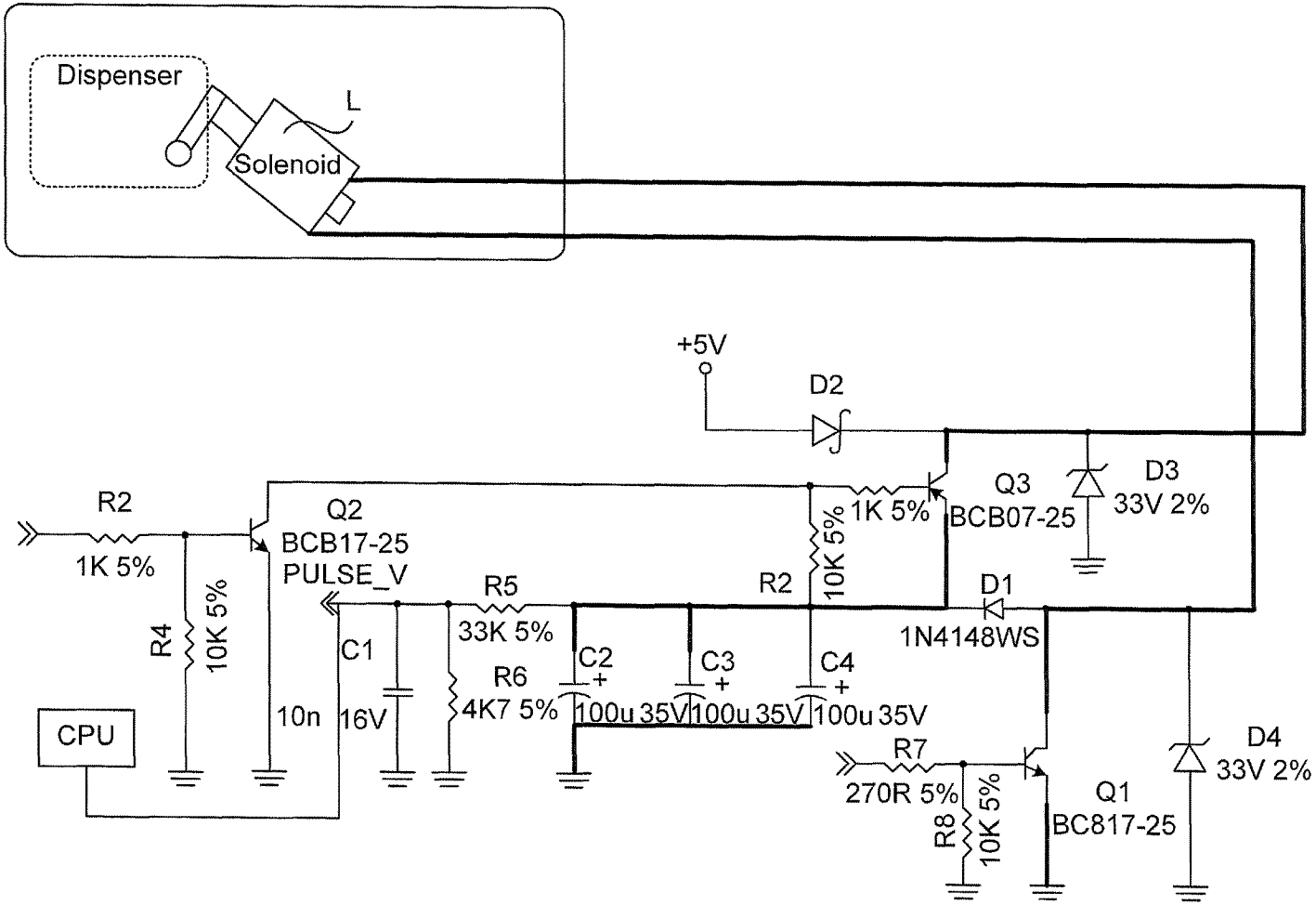
FIG. 2 shows a more detailed circuit diagram of a circuit for driving an inductive load in the form of a solenoid valve according to embodiments of the present invention.

FIG. 2 shows a more detailed circuit diagram of a circuit for driving an inductive load in the form of a solenoid valve according to embodiments of the present invention. The circuit diagram of FIG. 2 will in the following illustrate a number of different embodiments of the present invention.

Similar to the circuit according to an embodiment, the circuit for driving the inductive load in the form of a solenoid valve denoted L comprises three switches all embodied in the form of transistors. In this particular example, bipolar junction transistors (BJTs) are used, but field effect transistors (FETs) can be envisaged. The first transistor Q1 is controlled to charge one or more capacitors C2-C4 from the +5 V voltage supply applied to the solenoid valve L. This supply voltage is further used to feed most of the other components of the circuit. By closing the first transistor Q1, a current is induced in the solenoid L from the supply voltage and passes via an input terminal of the first transistor through an output terminal to ground. In this context, when using NPN-type BJTs, the control terminal is equal to the base terminal, the input terminal is equal to the collector terminal, and the emitter terminal is equal to the output terminal, since the BJT is controlled via its base terminal to transfer a current from the collector terminal to the emitter terminal. In the following, the terminology of the BJT will be used to refer to the different terminals.

Thereafter, when the first transistor Q1 is opened, the current induced in the solenoid L will charge the capacitors C2-C4. This process of opening and closing the first transistor Q1 is repeated until the capacitor is fully charged as measured by a device such as a microprocessor (not shown) measuring the voltage level over the capacitors C2-C4. By repeating the process of having the current induced in the solenoid L charge the capacitors C2-C4, the energy in the capacitor is steadily increased. The first diode D1 is employed in order to prevent the capacitor C from discharging via the first transistor Q1. When the capacitor is considered to be sufficiently charged, as determined by the microprocessor measuring the voltage over the capacitors C2-C4 and comparing the measured voltage to a predetermined level, which level in practice is approximately 30-32 V, the first transistor Q1 is opened and the charging of the capacitors is discontinued.

Thereafter, the second transistor Q2 is closed, the closing of which in its turn closes the third transistor Q3. The third transistor Q3 must be able to handle a voltage level of approximately 30-32 V. The second transistor Q2 thus acts as a level shifter from 5 V to 32 V. Two resistors R1 and R2 constitute a voltage divider at the base terminal of the third transistor Q3. Thus, when closing the second transistor Q2, the point where the two resistors R1 and R2 is pulled via the second transistor Q2 to ground. Since the third transistor Q3 is of PNP type, this will close the third transistor, wherein the capacitors C2-C4 connected to the emitter terminal of the third transistor Q3 is discharged, and the voltage stored across the capacitors C2-C4 is transferred to the solenoid L via the collector terminal of the third transistor Q3. Subsequently, when the first transistor Q1 is closed, the relatively high voltage (30-32 V) transferred to the solenoid valve L causes a correspondingly high current to flow through the inductor of the solenoid valve L and via the first transistor Q1 to ground. Thus, by charging the capacitors C2-C4 to a sufficient voltage level, a current pulse flowing through the solenoid is produced, which is great enough to actuate the valve associated with the inductor in the solenoid valve L. The actuation of the valve will open the dispenser and dispense detergent and/or rinse aid into the compartment of the dish washer.

For instance, the very first time during a washing program when a current pulse is created to open the dispenser, the current pulse is dimensioned (typically by a microprocessor measuring the voltage across the capacitors C2-C4 and controlling the three transistors) to open dispenser such that detergent is dispensed in the washing compartment, while the mechanical valve only is open for about 100 ms, thus having only a very small amount of rinse aid entering the washing compartment. For subsequent dispense of rinse aid in the washing compartment, the first transistor Q1 is opened such that valve for dispensing rinse aid is open from about 10 seconds up until 1 minute.

With further reference to FIG. 2, the circuit further comprises a second diode D2 in the form of a Schottky diode. An anode terminal of the Schottky diode D2 is connected to the +5 V power supply while a cathode terminal is connected to the inductive load L for protecting the power supply. The voltage drop of a Schottky diode is very low when the diode is forward-biased, while the diode blocks any possible discharge current from the solenoid when reverse-biased.

In yet another embodiment, the circuit comprises a third diode D3 for protecting the third transistor Q3 and a fourth diode D4 for protecting the first transistor Q1, the third and the fourth diodes being zener diodes. In this particular example, each of the two diodes has a breakdown voltage of 33 V. Thus, should the voltage over the respective diode D2 and D4 exceed 33 V, it will start to conduct and protect the transistors from being damaged by over-voltage hazards. A further advantage is that voltage across the capacitors C2-C4 never will exceed 33 V. Thus, the zener diodes D3 D4 act as regulators.

There is hence no need to have the microprocessor CPU to monitor maximum charge voltage at PULSE_V.

Even though the invention has been described with reference to specific exemplifying embodiments thereof, many different alterations, modifications and the like will become apparent for those skilled in the art. The described embodiments are therefore not intended to limit the scope of the invention, as defined by the appended claims.

The invention claimed is:

1. A method of driving an inductive load comprising the steps of:

applying a supply voltage to the inductive load;

closing and opening a first switch connected to a capacitor and the inductive load, wherein the capacitor is charged by the supply voltage via the inductive load;

measuring a voltage over the charged capacitor, wherein the charging of the capacitor is discontinued when the voltage over the charged capacitor has reached a predetermined level greater than that of the supply voltage;

closing a second switch, an input terminal of which being connected to a control terminal of a third switch via a first resistor, the capacitor further being connected to the control terminal of the third switch via the first resistor and an input terminal of the third switch, and to the input terminal of the second switch via a second resistor, wherein the third switch closes and causes the capacitor to discharge via the third switch into the inductive load; and closing of the first switch, which causes a current sufficient for actuating a mechanical valve associated with the inductive load to be induced in the inductive load.

2. A dish washer performing the steps of the method according to claim 1.

3. A circuit driving an inductive load comprising:

an input arranged to be connected to a supply voltage and an output arranged to apply the supply voltage to the inductive load;

a first switch;

at least one capacitor;

the first switch being connected to the capacitor and the inductive load, wherein closing and opening of the first switch causes the capacitor to be charged by the supply voltage via the inductive load;

a device for measuring a voltage over the charged capacitor, which further is arranged to control the first switch to discontinue the charging of the capacitor when the voltage over the charged capacitor has reached a predetermined level greater than that of the supply voltage;

a second switch;

a third switch being connected to the inductive load and the capacitor;

a first diode, an anode terminal of which being connected to an input terminal of the first switch and the inductive load and a cathode terminal of which being connected to said at least one capacitor and an input terminal of the third switch;

a second diode, an anode terminal of which being connected to the input for receiving the supply voltage and a cathode terminal of which being connected to an output terminal of the third switch and the inductive load;

a first resistor via which the input terminal of the second switch is connected to the control terminal of the third switch; and a second resistor via which the first resistor and the input terminal of the second switch is connected to said at least one capacitor;

the second switch being connected to a control terminal of the third switch, the capacitor further being connected to the control terminal and an input terminal of the third switch, wherein closing of the second switch causes closing of the third switch and discharging of the capacitor via the third switch into the inductive load, and closing of the first switch causes a current sufficient for actuating a mechanical valve associated with the inductive load to be induced in the inductive load.

4. The circuit according to claim 3, wherein closing of the first switch causes a current to be induced in the inductive load and flow through the first switch.

5. The circuit according to claim 4, wherein opening of the first switch causes the current induced in the inductive load to charge the at least one capacitor.

6. The circuit according to claim 3, the first, second and third switch being transistors.

7. The circuit according to claim 6, further comprising:

a third diode, a cathode terminal of which being connected to the output terminal of the third transistor and an anode terminal of which being connected to ground; and a fourth diode, a cathode terminal of which being connected to the input terminal of the first transistor and an anode terminal of which being connected to ground.

8. The circuit according to claim 3, the mechanical valve being arranged to open a dispenser for dispensing detergent and/or rinse aid.

9. The circuit according to claim 3, wherein:

the device for measuring a voltage over the charged capacitor is a microprocessor, said microprocessor further being arranged to control the switching of the first, second and third switch.

10. The circuit according to claim 3, the at least one capacitor comprising a plurality of capacitors.

11. A dish washer comprising the circuit of claim 3.

* * * * *